US005427309A

United States Patent [19]

Voss

[11] Patent Number: 5,427,309

[45] Date of Patent: Jun. 27, 1995

[54] CORRUGATED BOX WITH V-GROOVED WALL

[75] Inventor: Harry A. Voss, Canandaigua, N.Y.

[73] Assignee: Rock City Box Company, Inc., Utica, N.Y.

[21] Appl. No.: 331,187

[22] Filed: Oct. 28, 1994

[51] Int. Cl.[6] ..... B65D 5/20; B65D 5/56

[52] U.S. Cl. ..... 229/182; 220/418; 229/931; 493/59; 493/69; 493/79; 493/907

[58] Field of Search ..... 493/59–62, 493/69, 79, 906–908; 220/416, 418, 441; 229/165, 182, 930, 931

[56] References Cited

U.S. PATENT DOCUMENTS

| | | | |
|---|---|---|---|
| 549,064 | 10/1895 | Gray | 229/931 |
| 2,026,698 | 1/1936 | Nelson | 229/931 |
| 2,056,094 | 9/1936 | Claff | 229/165 |
| 2,139,845 | 12/1938 | Neely | 229/30 |
| 2,634,046 | 4/1953 | Weber | 229/34 |
| 2,932,439 | 4/1960 | Sparling | 229/31 |
| 2,985,075 | 5/1961 | Knutsson-Hall | 229/931 |
| 3,039,372 | 6/1962 | LaBombard | 93/58.3 |
| 3,649,398 | 3/1972 | Keith | 156/79 |
| 3,654,053 | 4/1972 | Toedter | 161/43 |
| 3,913,822 | 10/1975 | Heaps, Jr. | 229/23 |
| 3,980,005 | 9/1976 | Buonaiuto | 493/79 |
| 4,244,508 | 1/1981 | Schulman | 229/182 |
| 4,373,929 | 2/1983 | Smith | 493/355 |
| 4,623,072 | 11/1986 | Lorenz | 493/906 |
| 4,883,555 | 11/1989 | Turngen | 493/907 |
| 4,905,864 | 3/1990 | Balin | 220/441 |
| 5,337,916 | 8/1994 | Voss | 229/931 |

FOREIGN PATENT DOCUMENTS

| | | | |
|---|---|---|---|
| 267694 | 8/1964 | Netherlands | 229/165 |

*Primary Examiner*—Gary E. Elkins
*Attorney, Agent, or Firm*—Trapani & Molldrem

[57] ABSTRACT

A box is formed of a blank of sheet material wherein a filler is sandwiched between an inner liner and an outer liner. A pair of V-grooves is formed parallel to each edge and another V-groove is formed parallel to the pair of grooves on the side away from the edge. The V-grooves of the pair of V-grooves have center lines spaced apart a distance of substantially two thicknesses of the sheet material. The blank is folded upwards at the single V-groove, and then is folded back at the pair of V-grooves to produce successive 90-degree folds. The outer liner extends continuously over the outer side, top edge, and inner side of the resulting double-thickness wall. A similar technique can produce a box with multiple-thickness walls.

9 Claims, 3 Drawing Sheets

CORRUGATED BOX WITH V-GROOVED WALL

BACKGROUND OF THE INVENTION

This invention relates to boxes and cartons for shipping, storage, or display, and is more particularly concerned with boxes formed of corrugated paper board or equivalent sheet materials where a filler is sandwiched between an inner liner and an outer liner. The invention relates not only to boxes and trays made of corrugated paper starting material, but also to boxes of other flat sheet material where a filler is sandwiched between outer and inner liners. An alternative filler can be, e.g., cellulose fiber or a foamed polymer. The liners can be paper, or in some cases a plastic film or metallized plastic film. The sheet material can also be wrapped chipboard.

Shallow boxes are often employed for carrying small items of merchandise, such as cosmetics, handkerchiefs, or packages of photographic film. The box is required to be lightweight but substantially rigid, and must have a neat and trim appearance. A layer of paper serves as the wrapper or liner, and can be plain or printed paper. The liner should continue over the side wall of the box covering all sides and edges so that the filler is entirely concealed. Any text, labels, or decoration printed on the liner should not be cut through. High stacking strength is desirable.

A typical cardboard box structure of this type is shown in U.S. Pat. No. 2,634,046, which provides a double-thickness side wall for added rigidity. In this case, the back is dadoed to form two channels parallel to the edge defining the folds where the side wall is formed. This results in rounded edges on the lower and upper parts of the side walls.

Other boxes where the folds occur at dadoed grooves are shown, e.g., in U.S. Pat. No. 2,932,439, and U.S. Pat. No. 2,139,845. Boxes where V-grooves are used at fold lines are described, e.g., in U.S. Pat. No. 3,654,053 and U.S. Pat. No. 3,913,822.

A box that is formed of corrugated or similar sheet material with a dado groove and a V-groove to form double-thickness side walls is described in my earlier U.S. Pat. No. 5,337,916, having a common assignee herewith. That patent is incorporated herein by reference. There, the blank is folded up at the V-groove to form a 90-degree fold and at the dado groove to form a 180-degree fold. The outer liner extends continuously over the outside, top edge, and inner side of the resulting double-thickness wall. This technique produces a box with high strength and good crush resistance, both vertically and laterally. The box of this construction provides excellent cushioning to the product that it carries, and avoids or eliminates most of the flexing that is associated with the previous boxes or trays of this type.

The inventor herein has recently discovered that a pair of V-grooves, parallel to each other and with their center lines spaced about two thicknesses of the material, will serve to make the 180 degree bend without use of the dado cut. This produces a somewhat stronger, more rigid top to the double-thickness wall, and has the advantages of the dado and V-groove construction in that the outer liner extends continuously over the bottom, side and top of the sidewall.

OBJECTS AND SUMMARY OF THE INVENTION

Accordingly, it is an object of this invention to provide a box of high strength and attractive appearance, and which avoids the drawbacks of the prior art.

It is another object to provide a box of high strength and crush resistance, with excellent cushioning.

It is yet another object to provide a box or tray that avoids undesirable flexing, and can be employed as a set-up box.

It is still another object to provide a box of high strength and crush resistance that employs V-grooves, but no dado cuts, to create the double-thickness side wall.

It is a still further object to provide such a box with side walls of multiple thicknesses.

In accordance with an aspect of this invention, a box is constructed from a blank of sheet material in which a filler is sandwiched between outer and inner liners. The blank is V-grooved to form a pair of V-grooves parallel to the side edges. Here, two V-shaped strips of the material, including the inner liner and the filler, are removed to leave V-shaped grooves forming a 90 degree dihedral angle. The distance between the center lines of the two V-grooves is substantially equal to two thicknesses of the sheet material. Another V-groove is formed parallel to the double V-grooves on the side away from the edges. The edges and the double V-grooves define inner side wall portions, and the double and single V-grooves define outer side wall portions. The blank is die cut at the corners.

To form the side walls, the blank is folded 90 degrees at the V-groove so that the outer wall portions extend upwards, and then the inner wall portion is folded 180 degrees inward so that the inner liner on the outer wall portion is adjacent the inner liner on the inner wall portion. The double V-grooves form a pair of 90-degree bends. The wedge of filler material between the two center lines fits against the V-shaped recess formed by the top parts of the outer wall portion and the inner wall portion. A hot melt glue or other bonding agent can be applied in conventional fashion to the three V-grooves and to the interface between the outer and inner wall portions. The V-groove and double V-groove combination gives the box a significantly increased stacking strength. Both because of the 90 degree fold an the single V-groove, and because of the two 90-degree folds at the top of the double-thickness wall.

Because the outer liner is continuous over the entire side wall, no overwrap is required.

The box can be constructed of double-wall corrugated paper with burst strength e.g., of 275, 350, or 500 pounds per square inch. The box can be utilized as a tray, with an inverted top made of the same materials as the base.

The box of this invention is extremely strong and resists both vertical and side crushing, gives excellent cushioning to the merchandise or product, and eliminates most of the flexing associated with the set-up boxes that it replaces.

The double V-groove foldover eliminates open exposed fluting, so that the box does not require the overwrapping that is associated with conventional V-grooved corrugated boxes. This reduces both material costs and manufacturing costs.

Also, the double V-groove foldover not only permits the 180-degree fold-back that gives increased stacking strength, but also maintains the integrity of the pre-printed outer liner.

The above and many other objects, features, and advantages of this invention will become apparent from the ensuing description of a preferred embodiment, to be read in connection with the accompanying Drawing.

DETAILED DESCRIPTION OF THE PREFERRED EMBODIMENTS

Figure 1:
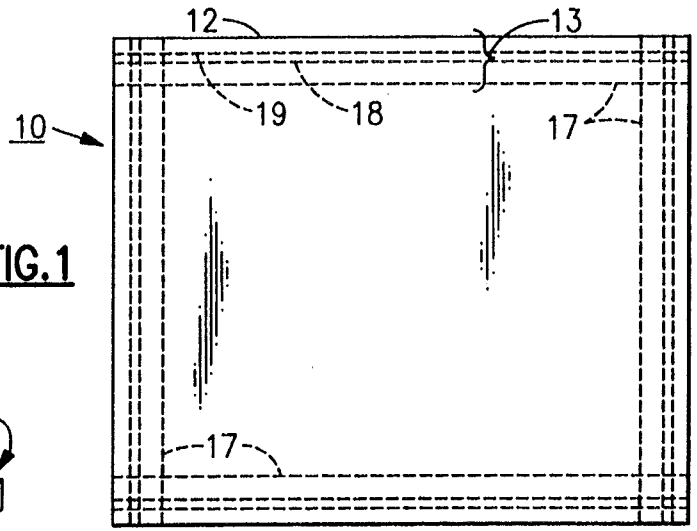
FIG. 1 is a plan view of a box blank of this invention showing locations of V-grooves.
Figure 2:
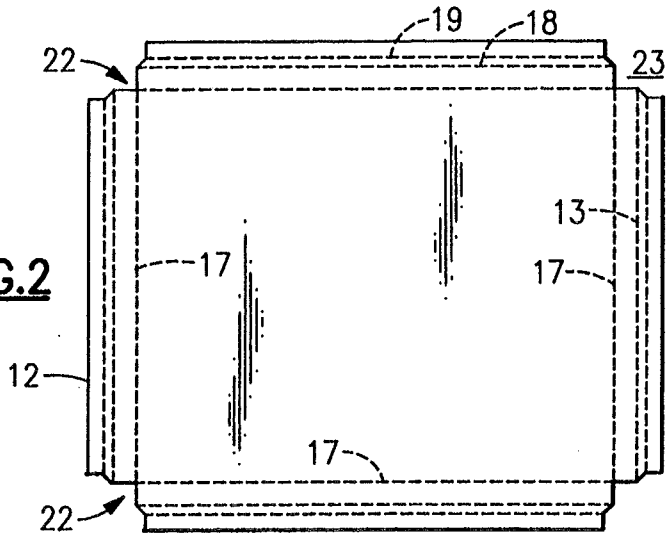
FIG. 2 is a plan view of the blank, with die-cut corners.

With reference to the Drawing, and initially to FIGS. 1 and 2 thereof, a shallow box or tray according to an embodiment of this invention and a method of constructing it involve a rectangular blank 10 of sheet material having a thickness t of about one-quarter inch in thickness. The blank 10 has a central base or floor panel 11 and four side edges 12, at each of which there is a respective side wall portion 13.

Figure 4:
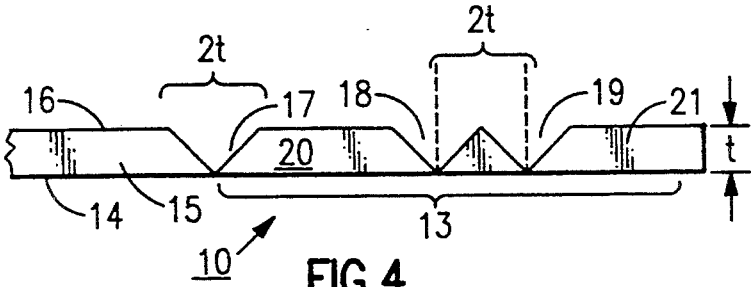
FIG. 4 is a schematic elevation showing the V-grooves in the box blank of this embodiment.

As shown in more detail in the cross-sectional elevation of FIG. 4, the blank material has a lower or outer liner 14 which is a sheet of paper optionally having a suitable coating, a filler 15 of corrugated paper or other suitable material (such as plastic foam), and a top or inner liner 16 of paper. The filler 15 is sandwiched between the two liners 14, 16.

Single V-grooves 17 are cut in the blank at the positions shown by dash lines in FIGS. 1 and 2. In this step the inner liner is removed and a V-shaped strip of the filler is removed, without curing through the outer liner 14. The V-grooves 17 extend parallel to the respective edges 12 and define the perimeter of the base panel 11.

Then, pairs of V-grooves 18 and 19 are cut parallel to the edges 12 and the V-grooves 17, and about midway therebetween. As shown in FIG. 4, in the zones of the pairs of V-grooves 18, 19, strips of the inner liner 16 and two prism-shaped strips of the filler 15 are removed. The outer liner 14 remains and extends continuously from edge 12 to edge 12. The twin V-grooves 18, 19 each have a width of about twice the thickness t of the blank, and the distance between the center line of the groove 18 and the center line of the groove 19 is substantially twice the thickness t of the blank. In each side wall portion 13, the respective single V-groove 17 and the groove 18 of the pair of V-grooves 18, 19 define an outer wall portion 20, while the edge 12 and the V-groove 19 define an inner wall portion 21.

Figure 3:
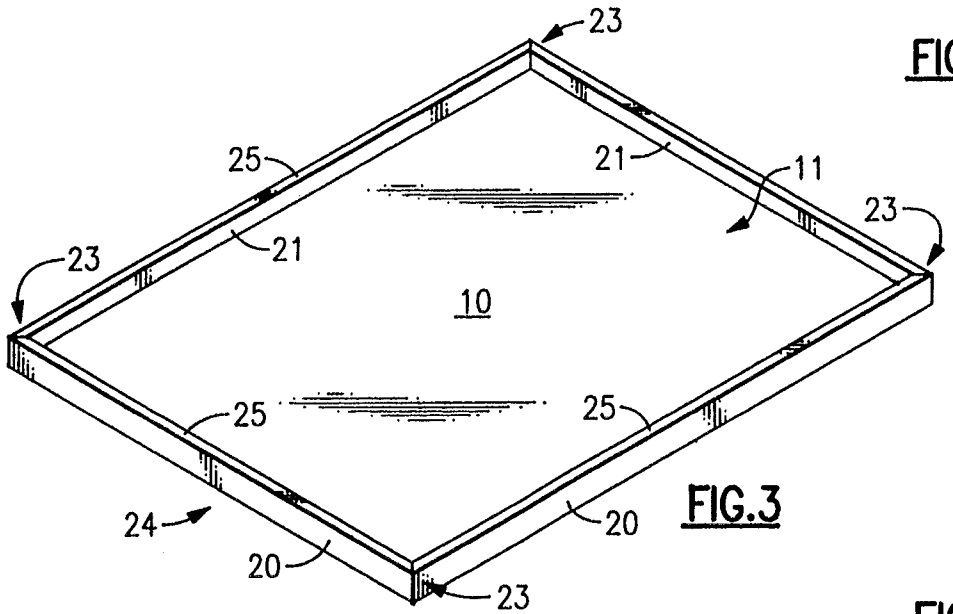
FIG. 3 is a perspective view of a box according to an embodiment of this invention.

As shown in FIG. 2, the die-cut corner cutouts 22 are formed at each corner of the blank 10, so that the side wall portions 13 fold together to meet at mitered corners 23 in the finished box or tray 24, as shown in FIG. 3.

The sequence in bending the blank 10 is shown in FIGS. 4, 5, 6, and 7.

A bonding agent, such as a hot melt glue, can be applied at the V-groove 17 and can also be applied to the twin V-grooves 18 and 19. Glue can also be applied to the inner liner 16 at the side wall portion 13.

Figure 5:
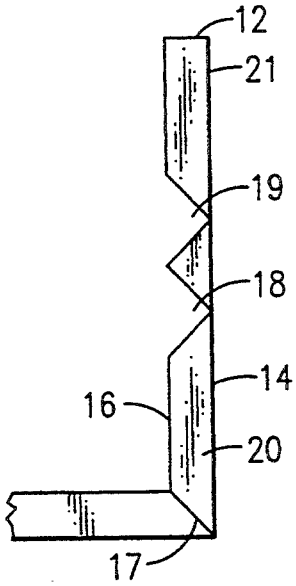
FIGS. 5, 6, and 7 show steps of folding at the V-grooves in forming the side wall in the box of this embodiment.
Figure 6:
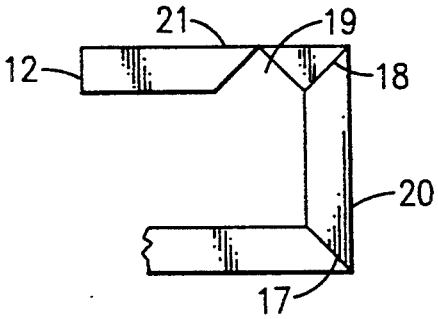
Figure 7:
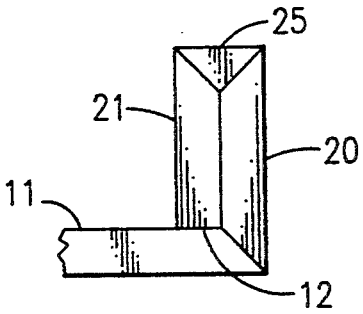

The blank 10 is bent ninety degrees at the V-groove 17 so that the outer wall portion 20 projects upwards, as shown in FIG. 5. Then the inner wall portion 21 is bent over at the V-groove 18, as shown in FIG. 6. Thereafter, the inner wall portion 21 is folded down at the V-groove 19, as shown in FIG. 7, so that the inner liner of the inner wall portion 21 contacts the inner liner of the outer wall portion 20. As is shown in FIG. 7, the outer liner 14 is continuous from the base panel 11 up the outer wall portion 21, across a top edge 25 of the side wall, and down the inner wall portion 20 to meet the inner liner 16. All of the filler is concealed at this stage, and no additional wrap is required. There is no exposed fluting.

The wall portions 13 are of double thickness and have excellent stiffness. The V-groove construction, in combination with the top edge 25 formed between the two ninety-degree folds at the V-grooves 18, 19, makes the side walls extremely strong. The flat 180-degree fold-back of the outer liner 14 at the top wall edge 25 increases stacking thickness without sacrificing integrity of the liner 14. The liner 14 can be pre-printed all the way to the edge 12.

In some alternative embodiments the V-grooves 17, 18, 19 can be used at a single edge of the blank or at selected side edges to form side walls, depending on the application.

Figure 8:
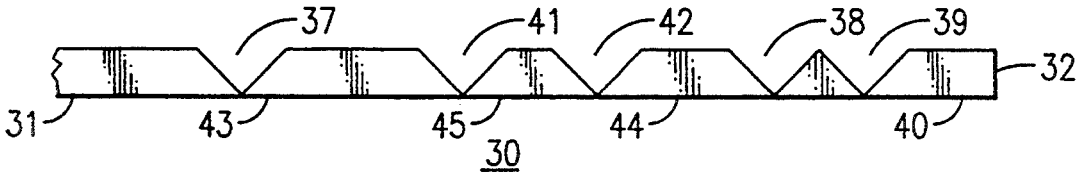
FIG. 8 is a schematic elevation showing the V-grooves in a box blank of a second embodiment.
Figure 9:
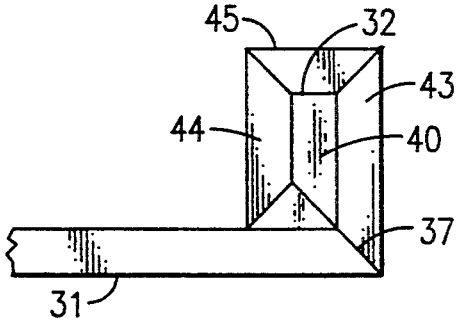
FIG. 9 is an elevation showing the resulting multi-thickness wall achieved with the second embodiment.

A second embodiment of this invention is shown schematically in FIGS. 8 and 9. Here V-groove construction is again used to form a three-thickness side wall for a box, tray, or other article. The sheet material of this embodiment is similar to that of the first embodiment, wherein a blank 30 is formed with a main floor portion 31 and edges 32, one of which is shown, with a side wall portion 33 extending therebetween. As with the first embodiment, the sheet material has an inner liner 34, a filler 35 and an outer liner 36. A first V-groove 37 is cut parallel to the edge 12. This V-groove 37 defines a 90-degree fold between the floor portion 31 and the side wall portion 33. A pair of V-grooves 38 and 39 are disposed on the side wall portion 33 and have their respective center lines spaced apart about two thicknesses t of the sheet material. A middle wall portion 40 is defined between the edge 32 and the groove 39. Another pair of V-grooves 41 and 42 are disposed parallel to the edge 32 and the other V-grooves, and about midway between the V-grooves 37 and 38. These V-grooves 41, 42 are disposed with their center lines spaced apart about three thicknesses t of the sheet material. An outer wall portion 43 is defined between the V-grooves 37 and 41, and an inner wall portion 44 is defined between the V-grooves 42 and 38.

A glue or bonding agent is applied as in the first embodiment, and then the blank 30 is folded at the V-grooves 37, 38, 39, 41 and 42 to form the three thickness side wall 13 with the middle portion 40 sandwiched between the inner portion 44 and the outer portion 43, as shown in FIG. 9. As in the first embodiment, the outer liner 36 is continuous and extends all the way over the outer wall portion 43, a top edge portion 45 of the wall, and the inner wall portion 44 to meet the inner liner. The three-thickness outer wall has superior stacking strength, even if a lesser thickness material is used. Of course, side walls of more than three thicknesses can be constructed using a similar technique.

While this invention has been described with reference to a preferred embodiment, it should be appreciated that the invention is not limited to that precise embodiment. Rather, many modifications and variations will present themselves to persons skilled in the art without departing from the scope and spirit of this invention, as defined in the appended claims.

I claim:

1. Method of forming a box from a blank of sheet material having an outer liner, an inner liner, and a filler sandwiched between said liners, said blank having at least one straight edge and said sheet material having a predetermined thickness; the method comprising the steps of:

forming a first V-groove parallel to said edge by removing a strip of said inner liner and a portion of said filler, leaving said outer liner to extend continuously therepast;

forming a pair of second and third V-grooves parallel to said edge and to said first V-groove, said second and third V-grooves having respective center lines spaced apart about two thicknesses of the sheet material;

said edge and said third V-groove defining an inner wall portion, and said first and second V-grooves defining an outer wall portion;

folding said blank upwards at said first V-groove to form a ninety-degree bend so that said outer wall portion extends upwardly therefrom; and folding said blank at each of said second and third V-grooves to form successive 90-degree folds, with said inner wall portion positioned against said outer wall portion to create a double-thickness wall, and with said outer liner extending continuously over an outer side, a top edge, and an inner side of said double-thickness wall.

2. The method of claim 1 further comprising the step of applying a bonding agent onto said V-grooves and onto the inner liner on said inner and outer wall portions.

3. The method of claim 1 wherein said blank has a second edge that meets said first-mentioned edge at a corner, and further comprising forming first, second, and third V-grooves in said blank parallel to said second edge; and die cutting the blank at said corner so that double-thickness walls can be formed at both said one and said second edges.

4. Method of forming a box from a blank of sheet material having an outer liner, an inner liner, and a filler sandwiched between said liners, said blank having at least one straight edge and said sheet material having a predetermined thickness; the method comprising the steps of:

forming a first V-groove parallel to said edge by removing a strip of inner liner and a portion of said filler, leaving said outer liner to extend continuously therepast;

forming a pair of second and third V-grooves parallel to said edge and to said first V-groove, said second and third V-grooves having respective center lines spaced apart about two thicknesses of the sheet material;

forming an additional pair of V-grooves parallel to said edge and to said first, second and third V-grooves, and between said first V-groove and the pair of said second and third V-grooves, the V-grooves of said additional pair having center lines that are space apart from one another by three thicknesses of said sheet material;

said edge and the first-mentioned pair of V-grooves defining a middle wall portion, and said first V-groove and said additional pair of V-grooves defining an outer wall portion, and said first-mentioned and said additional pair of V-grooves defining an inner wall portion;

folding said blank upwards at said first V-groove to form a ninety-degree bend so that said outer wall portion extends upwardly therefrom; and folding said blank at said second and third V-grooves to form successive 90-degree folds;

folding the V-grooves of said additional pair to form successive 90-degree folds to create a three-thickness wall with said middle wall portion sandwiched between said inner wall portion and said outer wall portion, and with said outer liner extending continuously over an outer side, a top edge, and an inner side of said three-thickness wall.

5. A shipping or storage container formed of a sheet material of a predetermined thickness and in which a filler is sandwiched between an inner liner and an outer liner; comprising a base panel extending between a plurality of side walls, the side walls each being of at least two thicknesses of said sheet material, and with each said side wall being formed of an inner wall portion and an outer wall portion, with a pair of parallel V-grooves cut in said sheet material extending parallel to a respective edge defining said inner wall portion therebetween, and another V-groove cut in said sheet material extending parallel to said pair of V-grooves defining said outer wall portion therebetween, with said outer liner extending continuously from said base panel to said edge, said outer wall portion being folded upwards at said other V-groove, and said inner wall portion being folded substantially 180 degrees at said pair of V-grooves, so that said outer liner extends continuously over an outer side, a top edge and an inner side of said side wall.

6. A shipping or storage container according to claim 5, wherein said side walls are of two thicknesses of said sheet material; and the V-grooves of said pair of V-grooves have center lines spaced apart a distance substantially two times the predetermined thickness of said sheet material.

7. A shipping or storage container according to claim 5, wherein said walls are of multiple thicknesses of said sheet material; the V-grooves of said pair of V-grooves have center lines spaced apart a distance substantially three times the predetermined thickness of said sheet material; and an additional pair of V-grooves are cut in said sheet material between the first-mentioned pair of V-grooves and said edge defining between said additional pair and said edge a middle wall portion; with the V-grooves of said additional pair having center lines spaced apart a distance substantially two times the predetermined thickness of said sheet material, and with said middle wall portion being folded upwards at said additional pair of V-grooves substantially 180 degrees.

8. A shipping or storage container according to claim 5, wherein all of said V-grooves are cut on the inner liner of said sheet material, leaving the outer liner to extend continuously over said V-grooves.

9. A shipping or storage container according to claim 5, wherein corners of said sheet material are die cut so that said side walls meet at mitered corners.

* * * * *